US010454165B2

(12) United States Patent
Shaw et al.

(10) Patent No.: US 10,454,165 B2
(45) Date of Patent: Oct. 22, 2019

(54) STACKED-DISK ANTENNA ELEMENT WITH SHAPED WINGS

(71) Applicant: Lockheed Martin Corporation, Bethesda, MD (US)

(72) Inventors: Robert Korey Shaw, Cinnaminson, NJ (US); Anthony R. Niemczyk, Southampton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/834,263

(22) Filed: Dec. 7, 2017

(65) Prior Publication Data

US 2019/0181547 A1 Jun. 13, 2019

(51) Int. Cl.

| | |
|---|---|
| ***H01Q 21/30*** | (2006.01) |
| ***H01Q 1/52*** | (2006.01) |
| ***H01Q 1/36*** | (2006.01) |
| ***H01Q 21/06*** | (2006.01) |
| ***H01Q 1/50*** | (2006.01) |
| ***H01Q 1/48*** | (2006.01) |

(52) U.S. Cl.

CPC ..... *H01Q 1/523* (2013.01); *H01Q 1/36* (2013.01); *H01Q 1/48* (2013.01); *H01Q 1/50* (2013.01); *H01Q 21/06* (2013.01)

(58) Field of Classification Search

CPC ..... H01Q 1/523; H01Q 1/36
USPC ..... 343/700 MS, 893
See application file for complete search history.

(56) References Cited

U.S. PATENT DOCUMENTS

| | | | | |
|---|---|---|---|---|
| 7,498,989 | B1 | 3/2009 | Volman | |
| 9,225,070 | B1 | 12/2015 | Zeweri et al. | |
| 9,880,241 | B2 * | 1/2018 | Ferrand | G01R 33/3642 |
| 10,164,344 | B2 * | 12/2018 | Kirino | H01Q 1/2291 |

* cited by examiner

*Primary Examiner* — Peguy Jean Pierre
(74) *Attorney, Agent, or Firm* — Howard IP Law Group

(57) ABSTRACT

A radiating element for a radar array antenna comprising a ground plane, a first electrically conductive disk arranged at a first distance from and generally parallel to the ground plane, and a second electrically conductive disk arranged at a second distance from and generally parallel to the ground plane. An electrically conductive element extends along a central axis of the radiating element and conductively couples the ground plane, the first electrically conductive disk and the second electrically conductive disk. The radiating element further includes a first wing defining a first surface opposing the electrically conductive element that is arranged at a first distance from the central axis, and a second surface opposing the electrically conductive element that is arranged at a second distance, different from the first distance, from the central axis.

18 Claims, 14 Drawing Sheets

STACKED-DISK ANTENNA ELEMENT WITH SHAPED WINGS

FIELD OF THE INVENTION

The present invention relates generally to radiating elements used in, for example, phased array radar systems.

BACKGROUND

Antenna arrays, such as those used in radar systems, are typically populated by a plurality of antenna elements or transducers which transduce electromagnetic energy between unguided and guided-wave forms. More particularly, the unguided form of electromagnetic energy is that propagating in "free space," while guided electromagnetic energy follows a defined path established by a transmission line, such as a coaxial cable, waveguides, dielectric paths, and other conductors and the like. The beam characteristics of an antenna are established, in part, by the size of the radiating portions of the antenna relative to the wavelength. In general, small antennas make for broad or nondirective beams, and large antennas make for small, narrow or directive beams. When more directivity (narrower beamwidth) is desired than can be achieved from a single antenna, several antennas may be grouped together into an array and fed together in a phase-controlled manner, to generate the beam characteristics of an antenna larger than that of any single antenna element. The structures which control the phase and apportionment of power to (or from) the antenna elements are termed "beamformers", and allow for the simultaneous generation of multiple antenna beams.

In order to transmit or receive electromagnetic signals, an antenna element must respond to an electromagnetic field traveling toward or from the desired direction. In order to respond to the electromagnetic signal, the antenna must have a finite physical extent or "aperture" in the desired polarization in order to interact with the field being transduced. A planar array of planar patch antenna elements, when viewed from a direction orthogonal to the plane of the array, has a physical extent which substantially equals the patch dimension for the polarization in question. Viewed from a location within the plane of the array, however, each patch antenna has substantially zero projected extent or dimension, at least in one polarization. Consequently, the ability of a planar array of planar or patch antennas to transceive in the direction of the plane may be limited, or in antenna terms it may have relatively low "gain". In addition to the problem of lack of projected dimension which results in low gain in the plane of the array, there is the problem that radiation to or from any one element of the array must pass by one or more adjacent antenna elements. These adjacent antenna elements tend to interact with so much field as may exist, which in turn tends to "block" the field to or from adjacent antenna elements. This interaction between mutually adjacent antenna elements of an array is termed "mutual coupling." One manifestation of mutual coupling is a tendency of the impedance of the antenna element to be dependent on the signal transduced by the adjacent (and sometimes semi-adjacent) elements. Mutual coupling often has adverse consequences in the overall operation of the array, and may be undesired. Moreover, developing antenna elements or arrays which reduce or mitigate mutual coupling often necessitates adding features which increase the cost of the individual elements, as well as complicate the manufacturing process.

As antenna arrays may be populated by large quantities of elements, these cost and manufacturing difficulties are further magnified.

Improved or alternative antenna element designs and configurations are desired.

SUMMARY

According to one embodiment of the present disclosure, a radiating element for a radar array antenna is provided. The radiating element comprises a ground plane, a first electrically conductive disk arranged at a first distance from and generally parallel to the ground plane, and a second electrically conductive disk arranged at a second distance from and generally parallel to the ground plane. An electrically conductive element extends along a central axis of the radiating element and conductively couples the ground plane, the first electrically conductive disk and the second electrically conductive disk. At least one feed element is provided and placed in electrical contact with the first electrically conductive disk. The radiating element further includes a first wing extending generally perpendicularly with respect to the ground plane. The first wing includes a first surface opposing the electrically conductive element that is arranged at a first distance from the central axis, and a second surface opposing the electrically conductive element that is arranged at a second distance from the central axis, different from the first distance.

In another embodiment of the present disclosure an antenna element is provided. The antenna element includes a first electrically conductive disk oriented coaxially with a central axis of the antenna element, at least one feed element in communication with the first electrically conductive disk, and a first wing. The first wing includes an exposed portion defined by a height extending from a first end thereof arranged proximate a surface of the antenna element to a second free end thereof, a width extending in a direction generally radially-outward with respect to the central axis, and a thickness. The width of the exposed portion of the first wing is varied over the height.

In another embodiment of the present disclosure, an array antenna is provided. The antenna includes a plurality of radiating elements according to the embodiments set forth above.

DETAILED DESCRIPTION

Figure 1A:
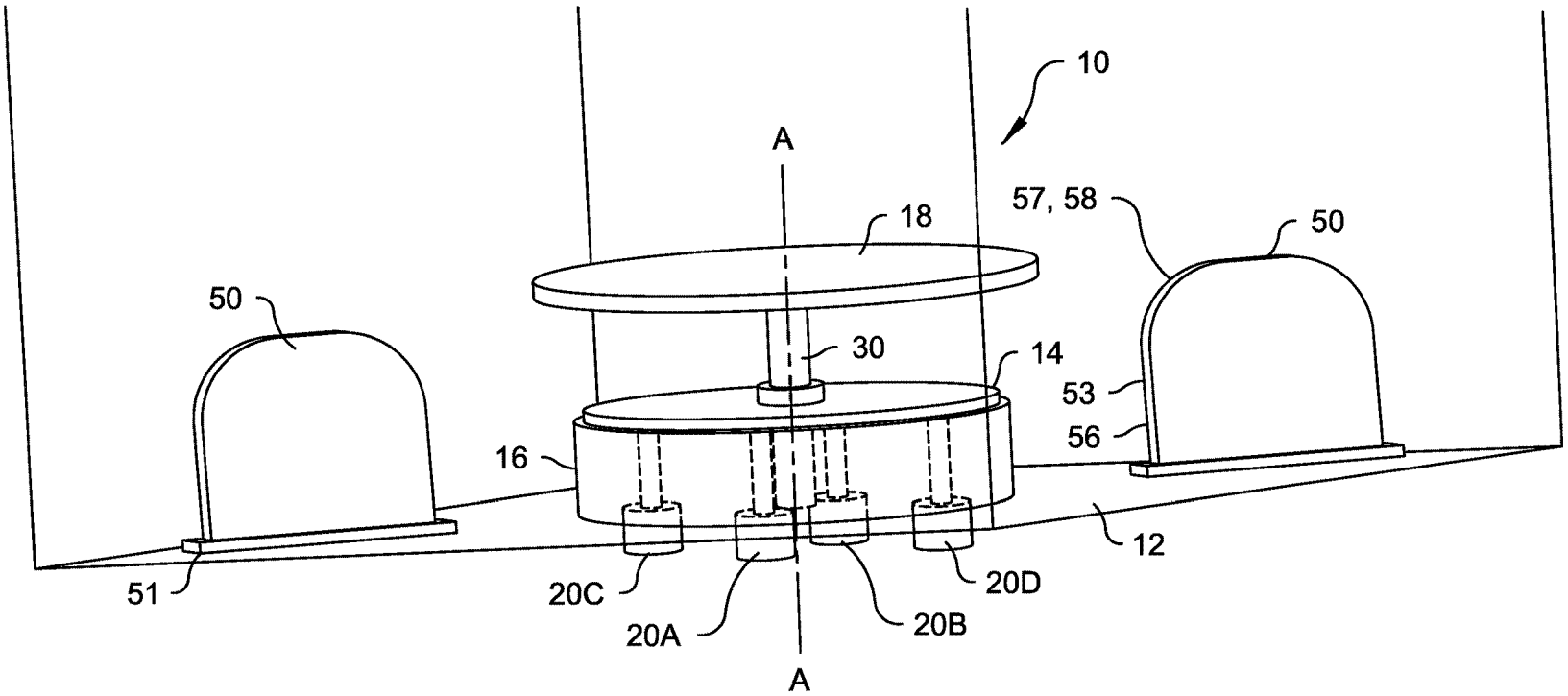
FIG. 1A is a perspective view of a radiating or antenna element according to an embodiment of the present disclosure.

It is to be understood that the figures and descriptions of the present invention have been simplified to illustrate elements that are relevant for a clear understanding of the present invention, while eliminating, for purposes of clarity, many other features found in signal transmission and reception systems, such as radar systems, including radiating elements of radar systems. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Antenna arrays according to embodiments of the present disclosure include a plurality of stacked upper and lower disk radiators or elements arranged in, for example, a lattice. For each radiator or antenna element, the lower disk is arranged on a dielectric disk or puck. The upper disk is supported by a central post or conductive element that runs though the lower disk and contacts a ground plane. The lower disk is fed by, for example, four feed probes spaced 90 degrees apart. Each pair of opposing probes may be fed by a 180 degree hybrid feed arrangement. These hybrid feed arrangements can be used to generate orthogonal slant linear polarizations. They can also be fed at a 0/180 degree phase for dual linear polarization operation, or at −90/+90 degree phase for dual circular polarization operation.

Each antenna element further comprises shaped metal (e.g. aluminum) or dielectric baffles or "wings" for controlling mutual coupling between neighboring elements and for improving the scan loss performance of the array. Wings according to the prior art have been defined by rectangular profiles. These designs have led to poor cross polarization and axial ratio of the element, and have been shown to block infringing fields of only one polarization. However, it has been unexpectedly discovered that by altering the profile of these wing elements, improvements in antenna element performance are realized. For example, in one embodiment of the present disclosure, each improved wing comprises a width that is varied over a height of the wing. In another embodiment, portions of the wing which oppose a central post or central axis of the antenna element are arranged at different distances with respect to the central axis. More specifically, in one particularly advantageous embodiment, an exposed portion of each wing may comprise two generally vertical sidewalls, a horizontal end wall on a free end thereof, and at least one radiused or rounded corner joining at least one of the vertical sidewalls and the end wall. In one embodiment, both corners of the free ends of each wing are radiused or rounded. The surface of the wing in this radiused area is arranged farther from a center of the antenna element compared to a surface defined on the vertical sidewall of the wing. These wing profiles achieve very low cross polarization levels compared to wing elements of the prior art at least by virtue of this variation in spacing.

Figure 1B:
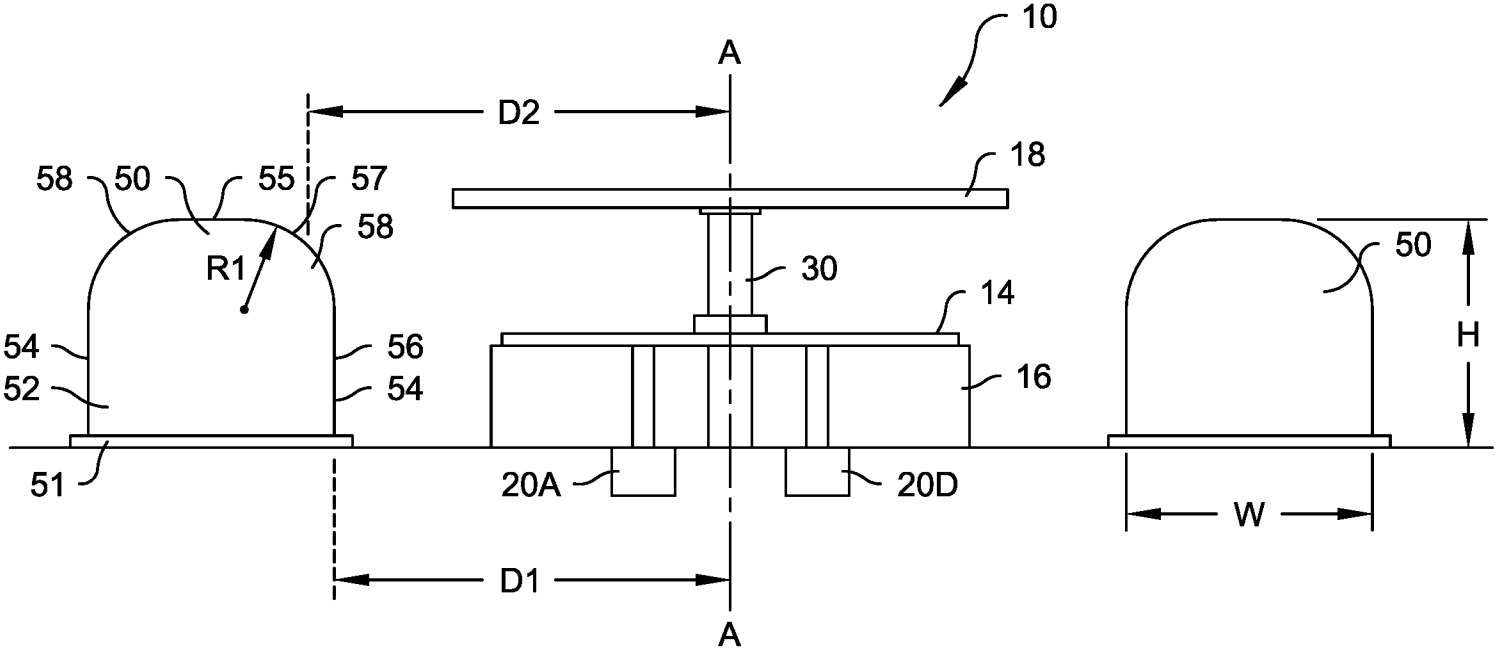
FIG. 1B is a side view of the antenna element of FIG. 1A.
Figure 1C:
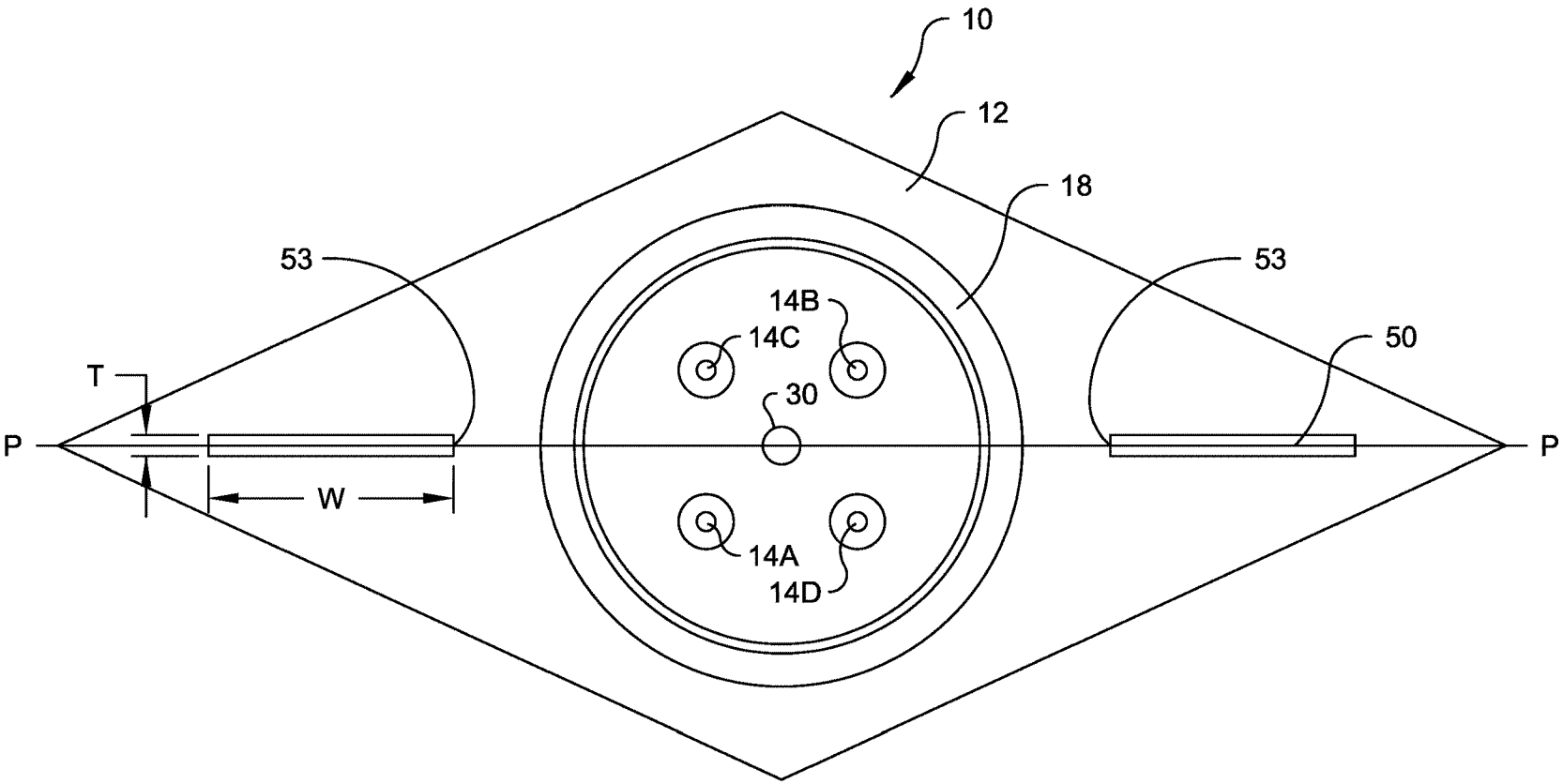
FIG. 1C is a top view of the antenna element of FIGS. 1A and 1B.

Referring generally to FIGS. 1A, 1B and 1C, a radiating or antenna element 10 according to an embodiment of the present disclosure is shown. Element 10 includes a ground plane 12 defining an upper or top surface. A first electrically conductive disk 14 of a first diameter is fixedly mounted at a distance above the top surface of ground plane 12, and may be centered about a central axis A of element 10. First disk 14 may be supported by dielectric material 16, which may be provided in the form of a puck or a disk, which in turn is supported on the upper surface of ground plane 12. The side of ground plane 12 on which first disk 14 is arranged may be referred to as the "radiating" side of element 10, in that electromagnetic transduction occurs in the half-plane above ground plane 12. A second conductive disk 18 having a second diameter is mounted concentrically and parallel with first disk 14, and is spaced therefrom at a location more remote from ground plane 12. More particularly, second disk 18 is arranged at a second distance from ground plane 12, greater than the distance between first disk 14 and ground plane 12. The diameter of first disk 14 may be smaller than the diameter of second disk 18.

An elongated thermally and electrically conductive element or rod 30 is affixed to ground plane 12 concentric with central axis A. Rod 30 extends through dielectric material 16, and makes thermal and electrical contact with the underside of second conductive disk 18. Rod 30 also makes thermal and electrical contact with first conductive disk 14, either peripherally where rod 30 passes through disk 14, or by being separated into two parts, one of which extends from ground plane 12 to the underside of disk 14, and another of which extends from the upper side of disk 14 to disk 18.

It should be understood that element 10 may be fed so as to transduce linear-only polarization or so as to transduce circular polarization. To transduce linear polarization, a lower surface of second disk 14 is fed at two locations, diametrically opposite to each other relative to central axis A, with signals which are out of phase. Such out of phase signals may be viewed as being represented by 0° and 180° phases. Thus, the signal feed for linear polarization may be viewed as applying relative 0° and 180° signals at locations 14A and 14B of disk 14. As an alternative, the 0° and 180° signals may be applied at locations 14C and 14D. See FIG. 1C. The linear feed for element 10 may be implemented by a pair of coaxial transmission lines 20A and 20B.

An outer conductor of coaxial transmission line 20A may be fixed to a periphery of an aperture extending through ground plane 12. Likewise, an outer conductor of transmission line 20B may also be affixed about an aperture formed through ground plane 12. As shown, center conductors of coaxial transmission lines 20A,20B extend upward from respective apertures, through dielectric material 16, and make contact with the underside of lower disk 14 at respective feed locations 14A,14B. Another linear feed for element 10 may be implemented by another set of coaxial transmission lines 20C and 20D. The outer conductor of coaxial transmission line 20C is affixed to the periphery of an aperture extending through the ground plane 12, which aperture is centered on a projection of feed location 14C, parallel with central axis A onto ground plane 12. Likewise, the outer conductor of coaxial transmission line 20D is affixed to the periphery of an aperture extending through the ground plane 12, which aperture is centered on a projection of feed location 14D, parallel with central axis A, onto ground plane 12. The center conductor of coaxial transmission line 20C extends upward from an aperture, through dielectric material 16, and makes contact with the underside of lower disk 14 at location 14C. Similarly, the center conductor of coaxial transmission line 20D extends upward from an aperture, through dielectric material 16, and makes contact with the underside of lower disk 14 at location 14D. Those skilled in the art would understand how coaxial transmission lines 20A-20D may be fed with relative 0° and 180° signals so as to effectuate a desired excitation.

Element 10 further comprises improved baffles or wings 50 arranged on a surface of element 10. In the illustrated embodiment, wings 50 are mounted or otherwise affixed to ground plane 12 and extend generally perpendicularly therefrom in a vertical direction. Wings according to embodiments of the present disclosure are configured to reduce mutual coupling between neighboring elements populating an array, increasing element efficiency and enabling excellent wide angle performance. Further, they are operative to reduce the flow of surface waves along an array of elements at large elevation scan angles, thereby increasing the bandwidth and scan ability of the antenna array.

Referring particularly to FIG. 1B, each wing 50 comprises a base 51 and an exposed portion 52 extending therefrom. A portion of wing 50 may be inserted into ground plane 12 and secured thereto (e.g., via a press-fit). Exposed portion 52 of wing 50 is defined by a height H, a width W and a thickness T (FIG. 1C). It has been determined that by varying width W over height H of wing 50, the above-described performance increases are realized. More specifically, each exemplary wing 50 includes two generally vertical sidewalls 54 and a linear, and horizontal top end wall 55 defining a free end. End wall 55 is connected to vertical sidewalls 54 via rounded corner walls 58 having an exemplary radius R1. Wing 50 includes a side 53 (FIG. 1C) generally facing or opposing central axis A or conductive element 30 of radiating element 10. Side 53 comprises a first portion or section 56 that is oriented at a first distance D1 from central axis A of element 10. A second portion or section 57 of side 51 is oriented at a second distance D2, greater than distance D1, from the centerline or central axis A of element 50. In a particularly advantageous embodiments, second portion 57 that is positioned further from central axis A is located proximate the free end of wing 50 and/or directly adjacent or proximate second conductive disk 18. In the illustrated embodiment, second portion 57 is defined by rounded corner wall 58. While the exemplary embodiment shows two rounded corner walls 58, other embodiments may comprise only a single rounded corner wall on a side of wing 50 opposing central axis A of element 10. As shown in FIG. 1C, wings 50 define, or are arranged in, a shared plane P oriented generally orthogonally with respect to ground plane 12. Central axis A may lie within plane P. Wings 50 are arranged diametrically opposite one another with respect to central axis A, with plane P lying equidistant from the feed elements or transmission lines 20A,20B,20C,20D.

Figure 2:
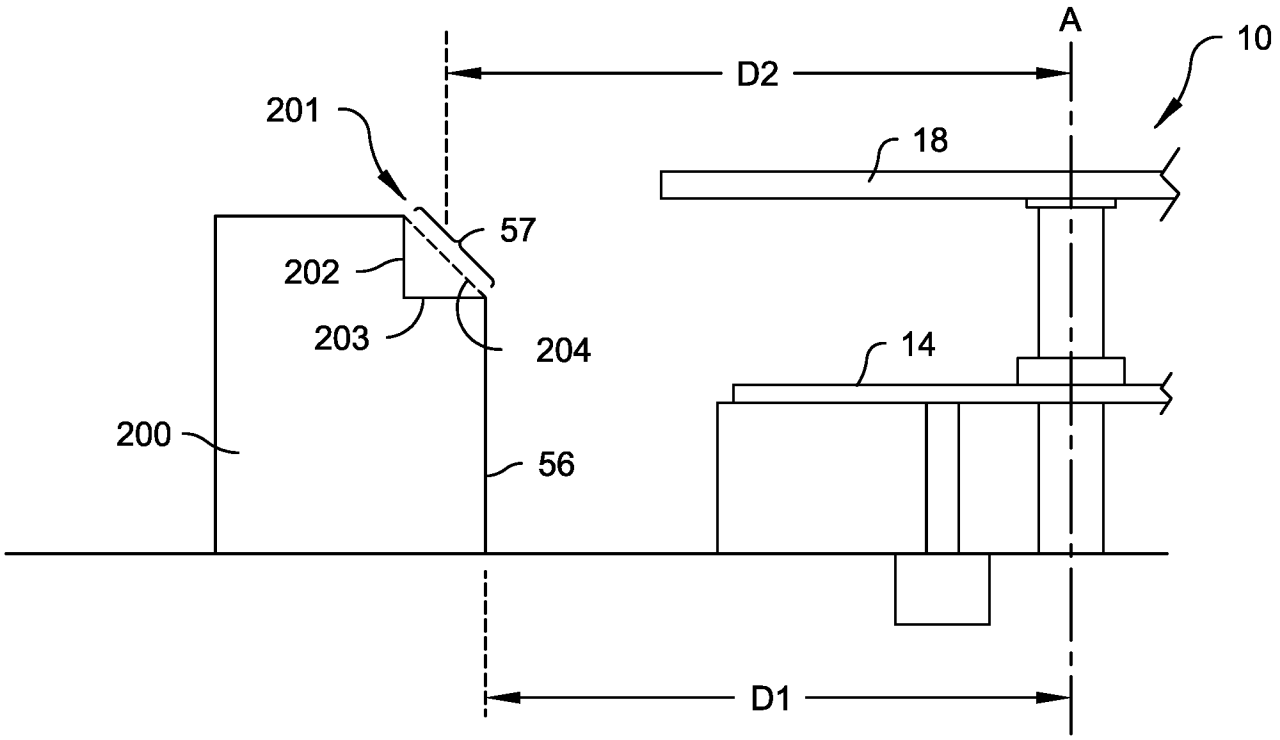
FIG. 2 is a side view of a wing for use with an antenna element according to embodiments of the present disclosure.
Figure 3:
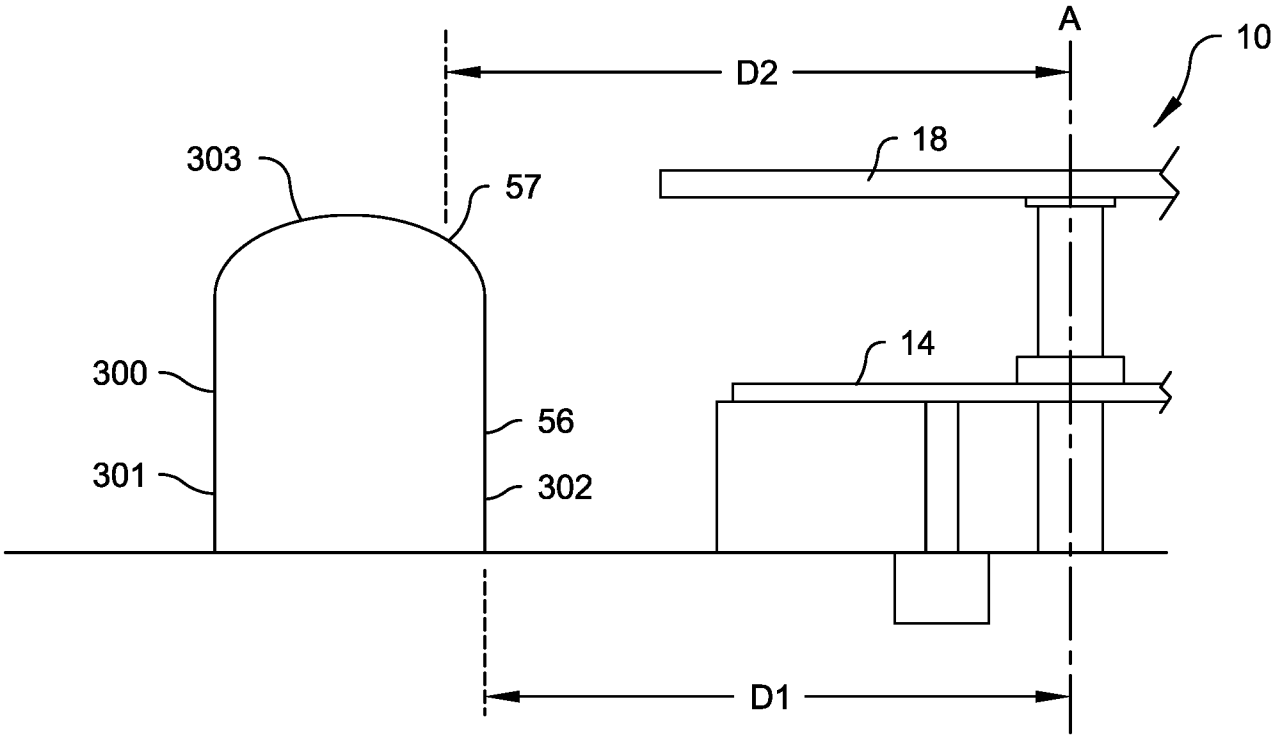
FIG. 3 is a side view of a wing for use with an antenna element according to embodiments of the present disclosure.
Figure 4:
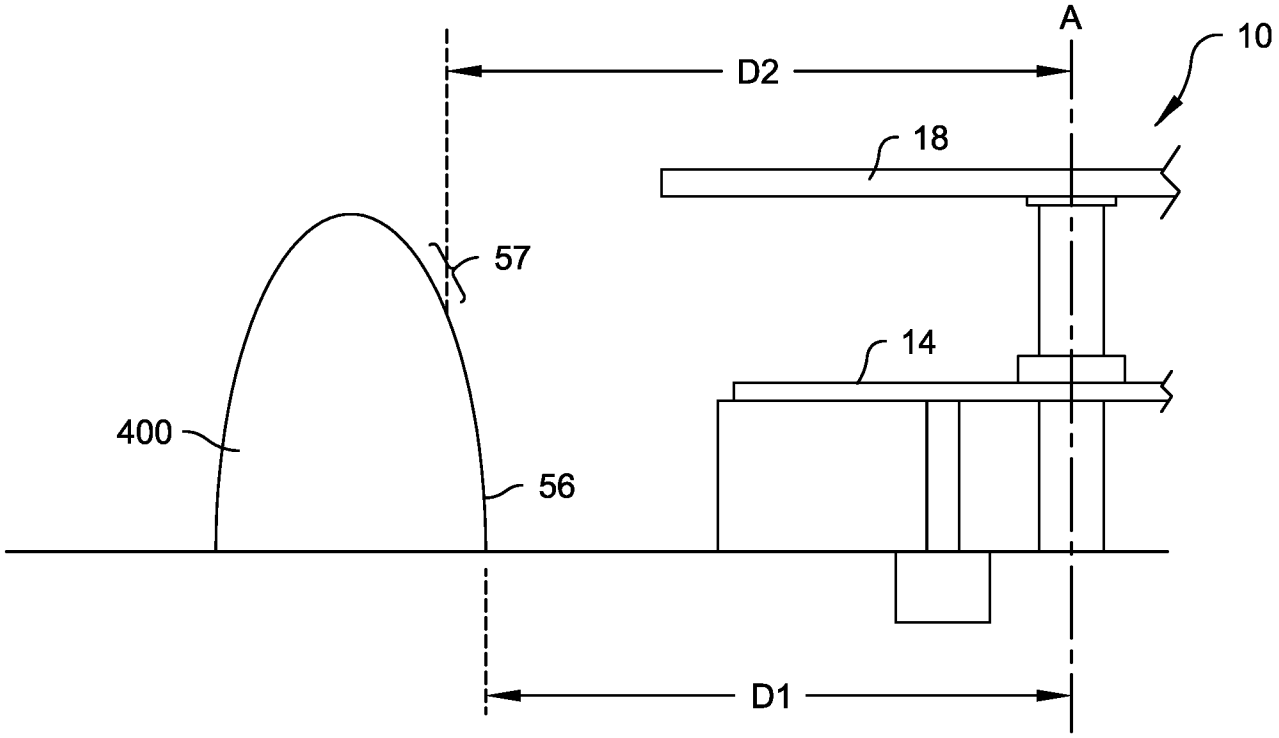
FIG. 4 is a side view of a wing for use with an antenna element according to embodiments of the present disclosure.
Figure 5:
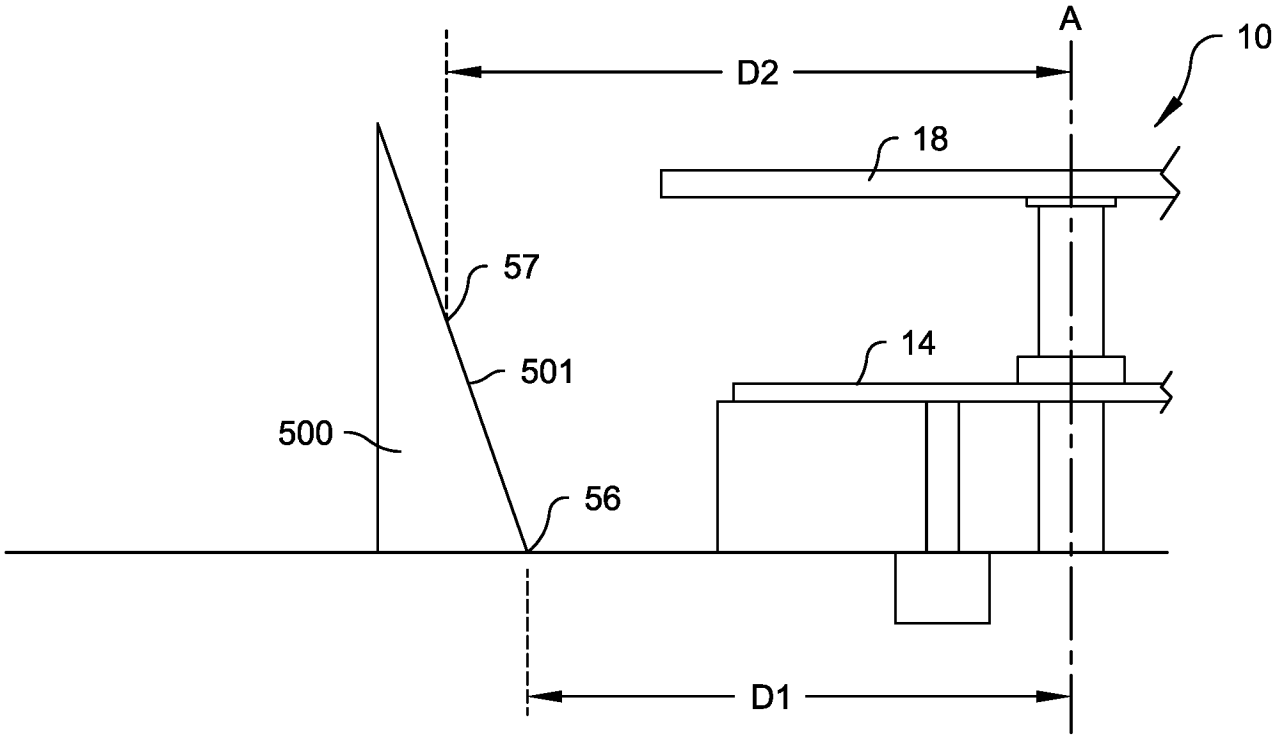
FIG. 5 is a side view of a wing for use with an antenna element according to embodiments of the present disclosure.

Referring generally to FIGS. 2-5, several alternative wing shapes according to embodiments of the present disclosure are shown, each having a sidewall opposing central axis A that is also non-parallel therewith. Each of these embodiments will be described as having first and second portions 56,57 arranged at distances D1 and D2 from a central axis A of radiating element 10, as described above with respect to FIGS. 1A, 1B and 1C. FIG. 2 illustrates a wing 200 in the form of a polygon, and more specifically, a generally rectangle shape having a notch 201 removed therefrom or formed therein to create second portion 57 arranged at a distance D2 that is farther from central axis A than a distance D1 associated with a first portion 56. Notch 201 may be defined by respective perpendicular vertical and horizontal wall segments 202,203 or via a single diagonal wall segment 204. FIG. 3 illustrates another embodiment of a wing 300 according to the present disclosure having a shape defined by two generally vertical sides 301,302 connected via an arcuate or arcing end wall 303. First portion 56 is defined along sidewall 302, while second portion 57 is defined by end wall 303. FIG. 4 illustrates a wing 400 defining a generally elliptical profile with first and second portions 56,57 defined thereby. FIG. 5 illustrates a wing 500 having a generally triangular profile defining first and second portions 56,57 along a wall 501 that generally opposes central axis A.

Figure 6:
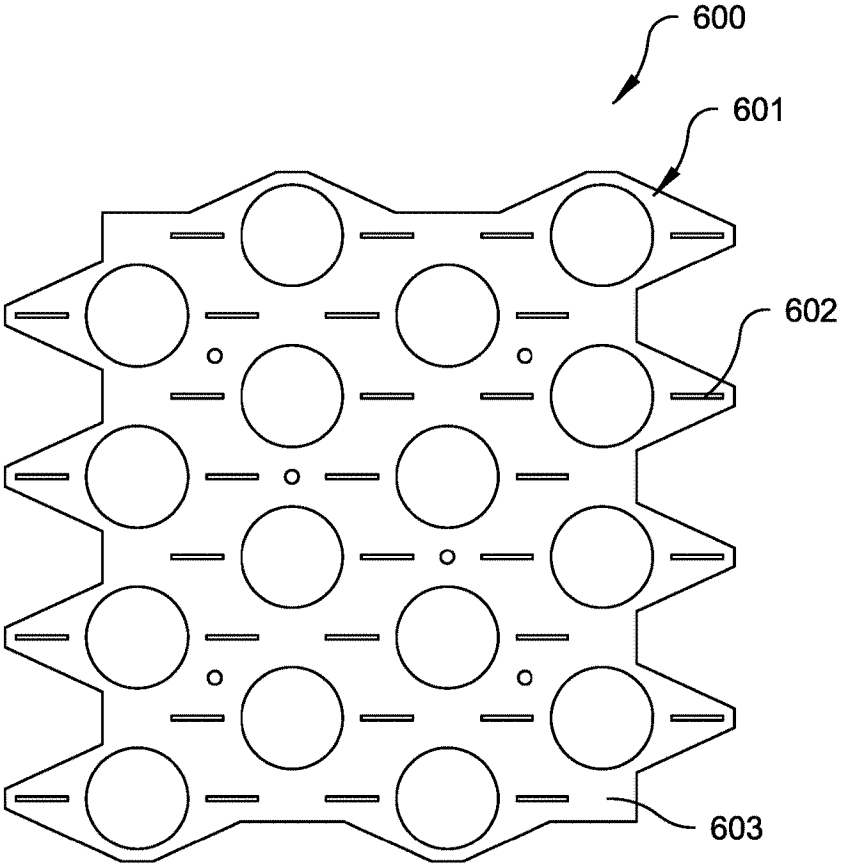
FIG. 6 is a top view of a four-by-four array of antenna elements according to an embodiment of the present disclosure.

FIG. 6 illustrates a "tile" or subarray 600 consisting of a plurality of antenna elements 601, each similar to element 10 of FIGS. 1A-1C, arranged in a staggered fashion. Exemplary subarray 600 comprises a four-by-four arrangement, with each of the sixteen antenna elements 601 thereof generally taking on a "diamond" shape (see also FIG. 1C). Antenna elements 601 share a common ground plane 603. As illustrated, each elemental antenna element 601 has its wings 602 oriented in-line with wings of adjacent antenna elements on horizontal lines or planes crossing subarray 600, and all such lines on which the wings lie are mutually parallel. Moreover, each wing 602 of each antenna element 601 lies partially between adjacent antenna elements in the vertical direction in the illustrated orientation. That is, each wing 602 does not lie directly between adjacent ones of the antenna elements, but each wing 602 lies partially between adjacent ones of the elemental antennas of subarray 600. A plurality of subarrays 600 may be interconnected in order to create antenna areas of any desired scale.

Figure 7A:
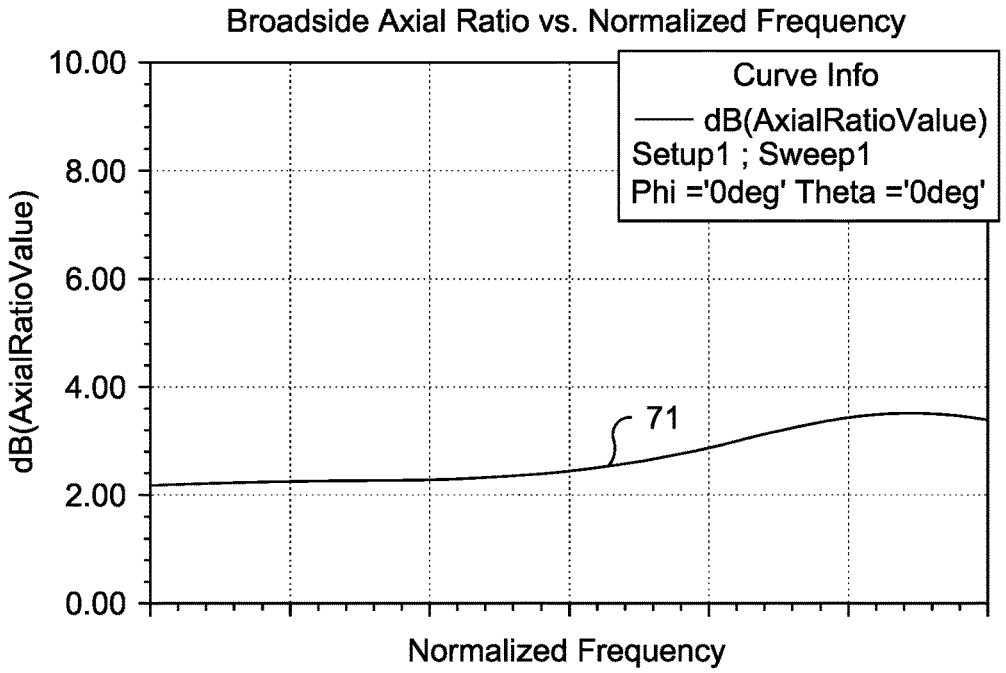
FIGS. 7A and 7B illustrate the axial ratio performance of an antenna element of the prior art.
Figure 7B:
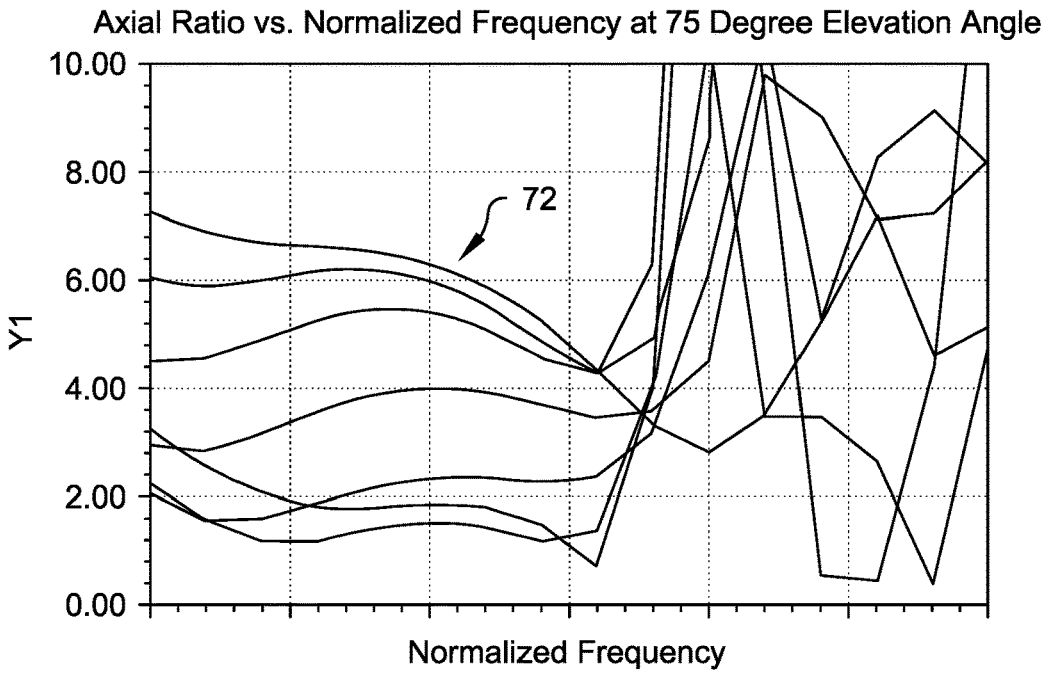
Figure 8A:
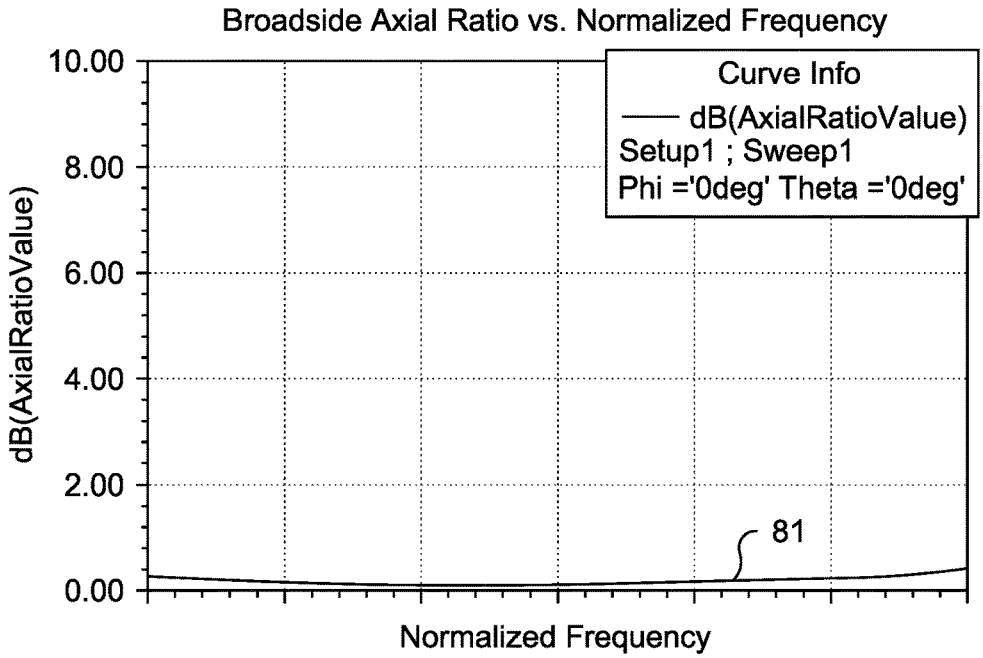
FIGS. 8A and 8B illustrate axial ratio performance of an antenna element according to an embodiment of the present disclosure.
Figure 8B:
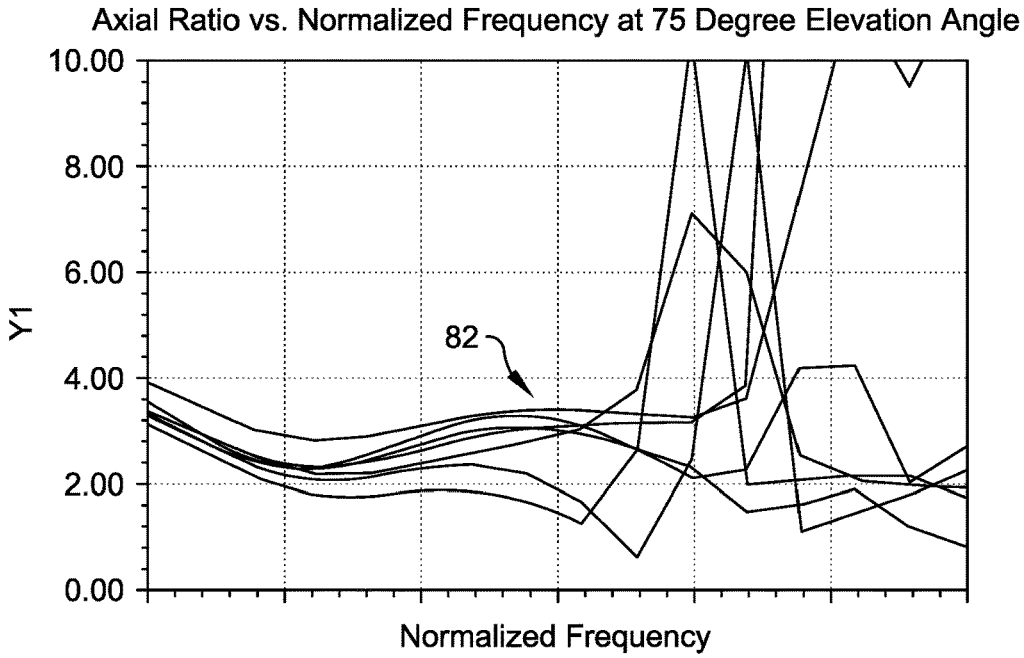
Figure 9A:
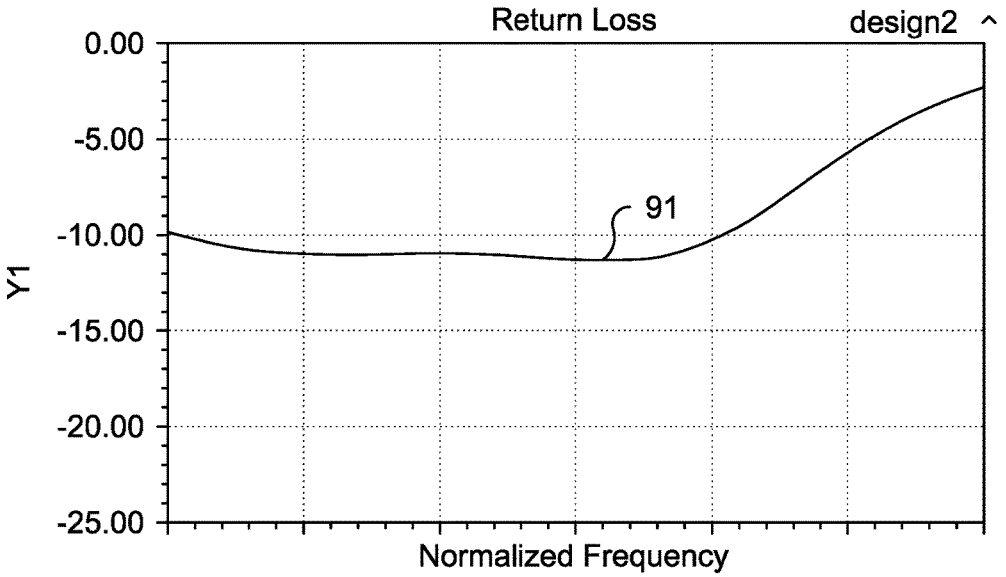
FIGS. 9A and 9B illustrate the return loss performance associated with an antenna element of the prior art.
Figure 9B:
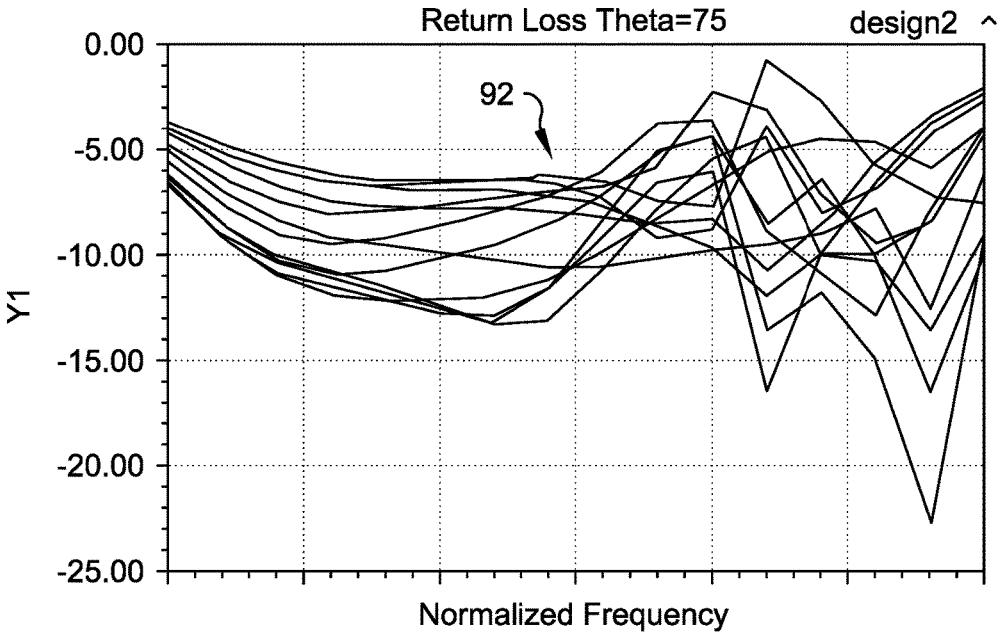
Figure 10A:
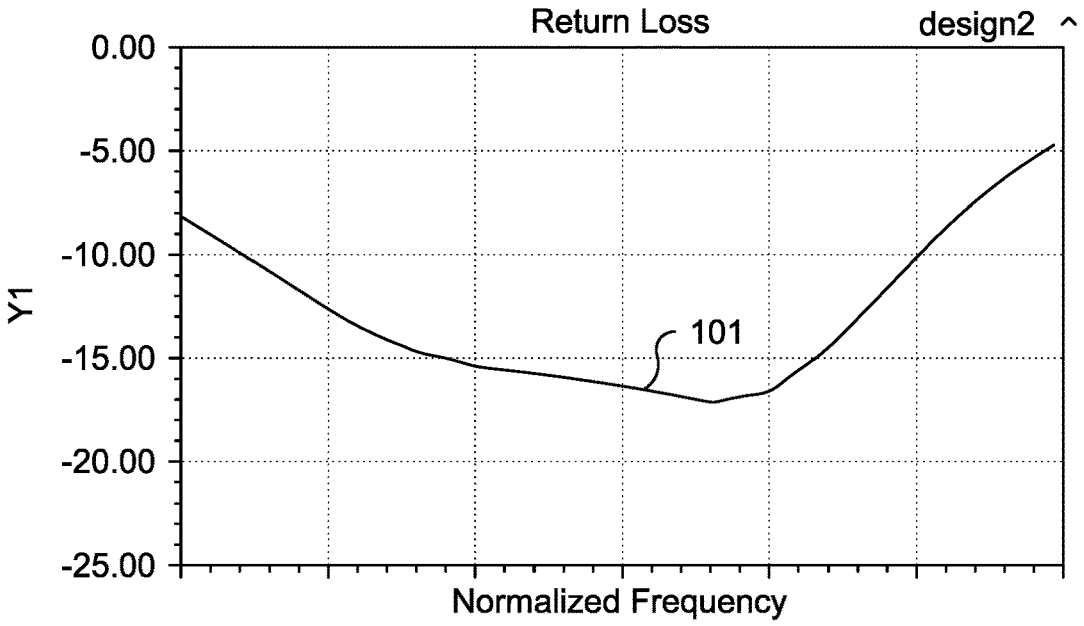
FIGS. 10A and 10B illustrate return loss performance of an antenna element according to an embodiment of the present disclosure.
Figure 10B:
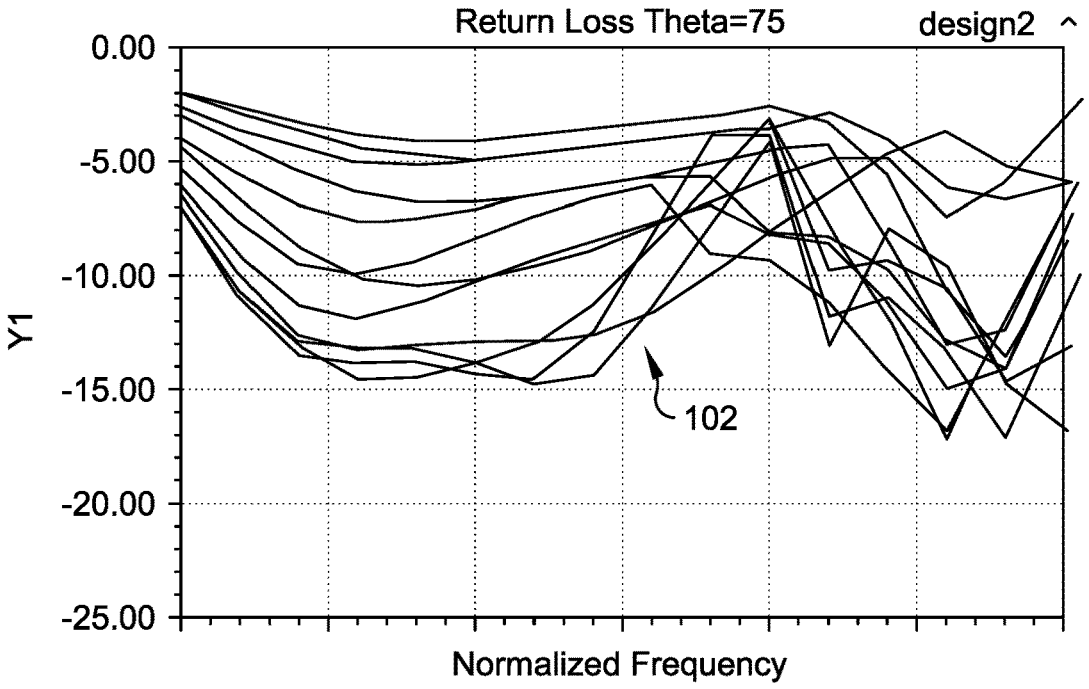
Figure 11:
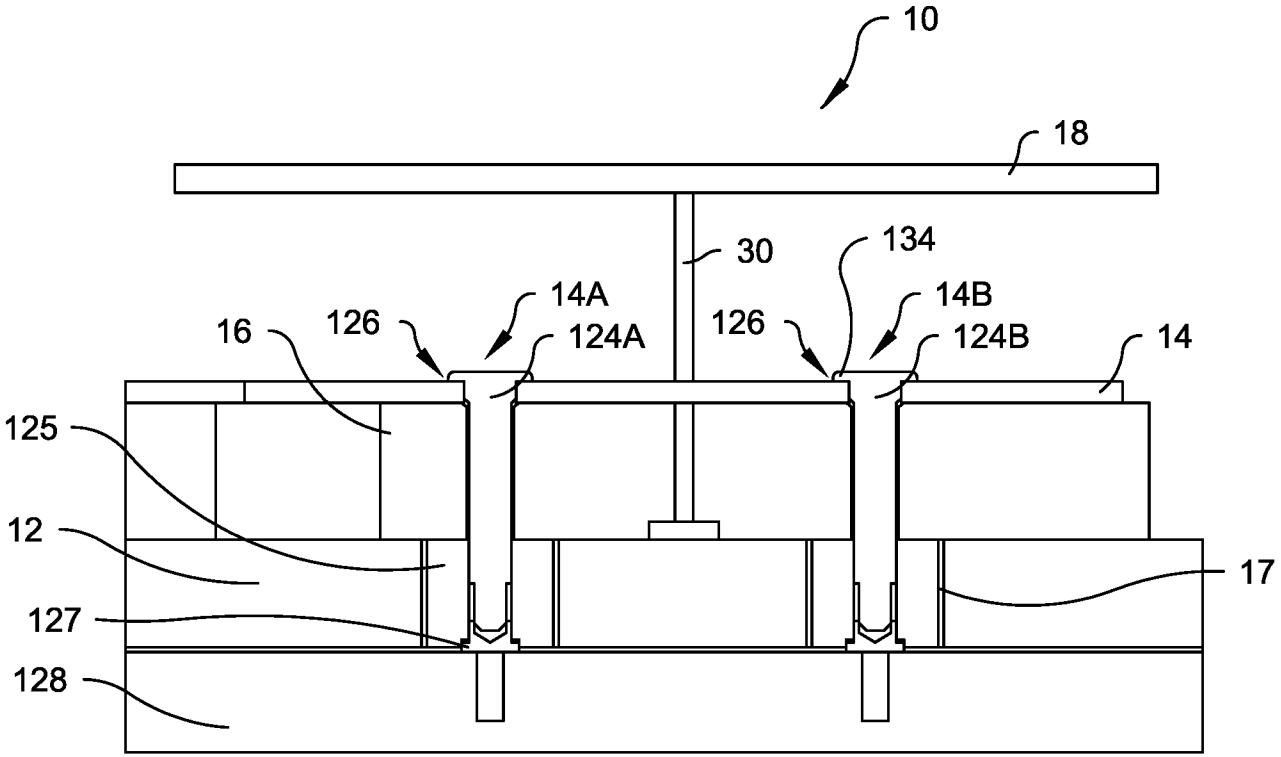
FIG. 11 is a cross-sectional view of a radiating or antenna element according to an embodiment of the present disclosure.
Figure 12:
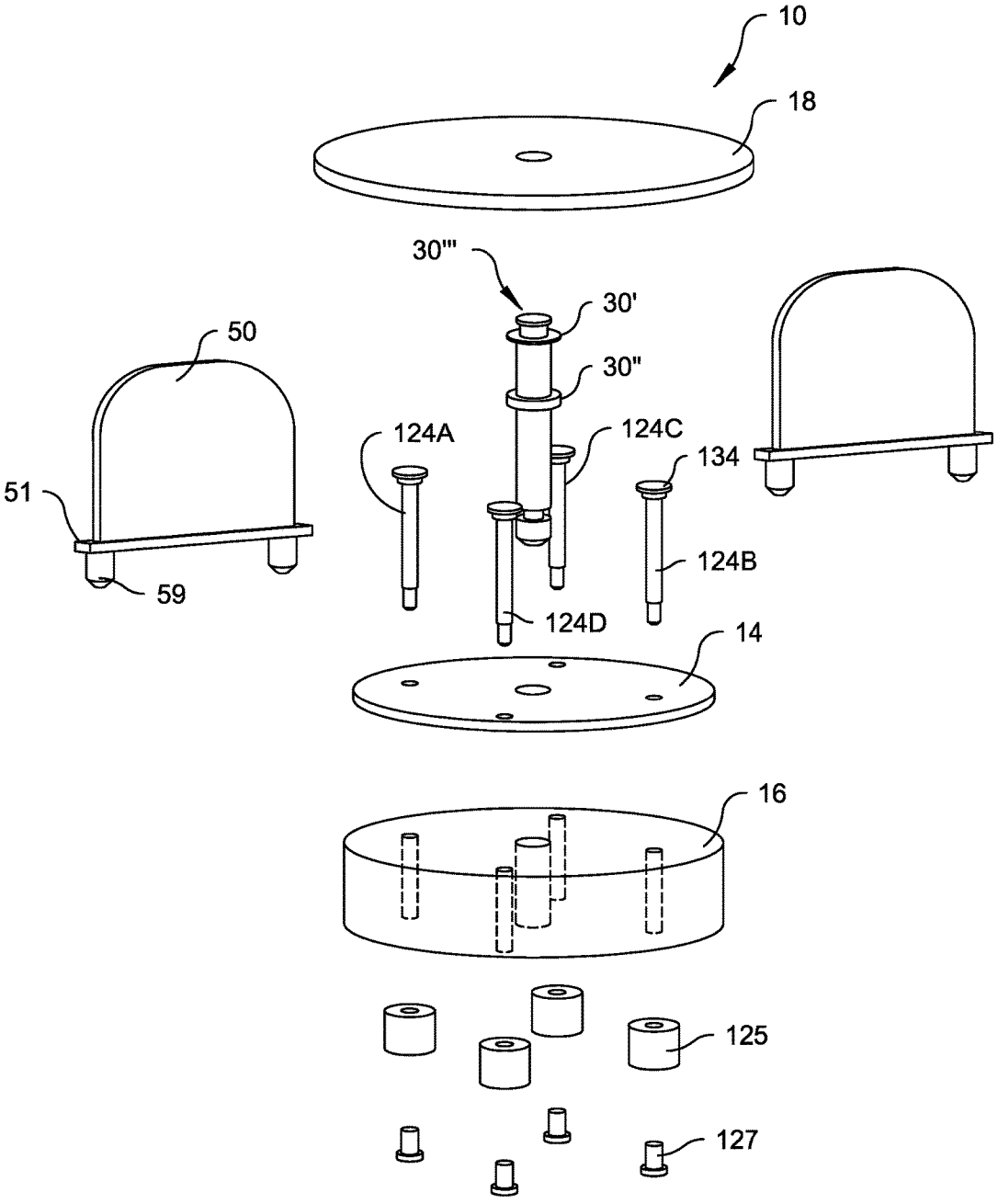
FIG. 12 is an exploded view of the antenna element of FIG. 11.

As described above, the shaped wings according to embodiments of the present disclosure have been shown to offer performance improvements over those utilized by the prior art. Referring to FIGS. 7A and 7B, the axial ratio performance (AR) vs. normalized frequency of an antenna element according to the prior art at a 0 degree scan angle (Theta, FIG. 7A) and at a 75 degree scan angle (FIG. 7B) are shown. Axial ratio is considered herein as the ratio between the major and minor axes of the polarization ellipse. At broadside, axial ratios 71 of over 2 dB are present, while at the high scan angles illustrated in FIG. 7B, axial ratios 72 of over 6 dB are present. Utilizing the improved wing element described above, and referring generally to FIGS. 8A and 8B, axial ratios 81 near 0 dB are realized at broadside, while at high scan angles, axial ratios 82 of under 4 dB are achieved. FIGS. 9A and 9B illustrate return losses 91,92 associated with the broadside and 75 degree scan angles, respectively, of the prior art antenna element. As shown in FIGS. 10A and 10B, improved broadside mismatch or return loss 101 and return loss 102 performance is realized via the shaped wing elements according to embodiments of the present disclosure. Broadside mismatch or return loss is a measure of the reflected power at each element while the array is steered to broadside, or perpendicular to the ground.

Embodiments of the present disclosure further include improved methods of manufacturing antenna elements, such as those set forth above with respect to FIGS. 1A-10B. Traditional antenna element manufacturing methods often include several steps that require specialized equipment and/or skilled labor, including etching of copper, hand soldering, precision machining, and the like. Embodiments of the present disclosure provide an improved method of manufacturing antenna elements which reduces the need for specialized equipment and the amount of required manual and/or skilled labor.

These improvements are realized, in part, by implementing the use of bulk metals into the antenna element, avoiding the thin, printed metal (e.g. copper) layers that are typically used in antenna element construction. More specifically, referring to FIGS. 1A-1C, 11 and 12, an exemplary method of manufacturing antenna element 10 includes forming a stacked conductive disk assembly. The assembly includes first or lower disk 14 formed by a stamping operation performed on generally planar metal stock. Apertures may be formed in lower disk 14 (e.g., via stamping or drilling) at each feed location 14A,14B,24C,24D for accepting four corresponding conductive posts or pins 124A,124B,124C, 124D, with each post 124 having a radially protruding nail-like head 134 and defining a portion of the transmission line conductors described above with respect to FIGS. 1A-1C. During manufacturing, each post 124 may comprise a solder ring 126 added around an end thereof proximate head 134. Posts 124 are inserted through corresponding apertures in lower disk 14 until their respective heads 134 abut disk 14, and are attached thereto via a single heating operation (e.g., placed in a furnace), wherein a soldered connection secures each post 124 to lower disk 14. This operation greatly reduces the assembly complexity of this unit in terms of reduction of specialized equipment and manual labor.

The stacked conductive disk assembly further includes second or upper disk 18 connected to disk 14 via a conductive element or rod 30. In one embodiment, disk 18 is also formed from a stamping and/or machining operation performed on bulk material stock. Similarly, rod 30 may be manufactured from casting and/or machining operations. Rod 30 may be attached to disk 18 via, for example, soldering, press-fit, or other techniques. In one particularly advantageous embodiment, rod 30 defines two annular shoulders 30',30" and comprises at least one hollow first end 30''' configured to be inserted through an aperture formed (e.g., stamped or drilled) into disk 18. Once inserted and disk 18 abuts shoulder 30', end 30''' of rod 30 may be flared or swaged, securing disk 18 thereto. This arrangement further reduces manufacturing complexity and costs.

The stacked disk assembly is completed by inserting a second end of rod 30 through an aperture formed (e.g., stamped or drilled) in disk 14 until making contact with shoulder 30". In other embodiments, rod 30 may be formed in two segments, as described above, with one segment arranged between disk 14 and disk 18, and another segment extending from an opposite side of disk 14, through dielectric material 16, to a ground plane or base plate 12, for example. In this way, disk 18, rod 30, disk 14 and posts 124 may comprise a conductive assembly of as many as eight individually manufactured components.

Dielectric material 16 (e.g., a dielectric disk or puck) may also be formed from machining operations performed on bulk dielectric stock. Ground plane or base plate 12 may be formed from material stock that has been machined to create apertures 17 therethrough. During assembly of element 10, each post 124 of the stacked disk conductive assembly is inserted through a corresponding aperture formed in dielectric material 16, as well as apertures 17 formed in ground plane 16. Posts 124 may be attached or electrically connected to a printed wire board (PWB) 128 of the antenna element via connectors, embodied herein as leaf pins 127 soldered to PWB 128. Leaf pins 127 define elastic conductive elements and are configured to permit a degree of axial and radial misalignment of posts 124, while still ensuring a reliable electrical connection and maintaining RF performance. These connectors also limit stresses placed on the solder joints over a large thermal range, as well as insure proper electrical connection of posts 124 throughout a range of tolerances of all of the components. More specifically, leaf pins 127 each define a metal surface mount component which may be soldered directly to PWB 128. Each leaf pin 127 consists of a wide base for added solder surface area as well as stability, and a hollow post that protrudes from the center away from PWB 128. The hollow post may be slotted, and subsequently compressed from its perimeter in order to reduce the inside diameter of the post. This reduced inside diameter generates an interference fit with each post 124 over a wide range of tolerances. The slot allows leaf pin 127 to act as a spring around post 124 so that post 124 may be easily be inserted or removed. The combination of the slots and the compressed portion allow leaf pin 127 to take up axial misalignment due to tolerance stackups and temperature deltas as well as minor radial misalignments. Teflon sleeves 125 may be provided within apertures 17 and arranged about leaf pins 127 for maintaining correct impedance through ground plane 16. Sleeves 125 define respective openings configured to receive each post 124.

As described above with respect to FIG. 1B, each wing 50 of an antenna element 10 may be secured to ground plane or base plate 16 via a press-fit connection. In one embodiment, in addition to base or flange 51, each wing 50 may further comprise two post-like protrusions 59 extending therefrom. Protrusions 59 are configured to be inserted (e.g. press-fit) into two corresponding apertures formed in ground plane 16, ensuring accurate location of the wings as well as simplifying assembly operations without the need for additional materials (adhesives, solder, etc.) or process steps. This configuration further improves positional tolerance of the wing location and the wing's angular orientation.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A radiating element for a radar array antenna comprising:

a ground plane;

a first electrically conductive disk arranged at a first distance from and generally parallel to the ground plane;

a second electrically conductive disk arranged at a second distance from and generally parallel to the ground plane;

an electrically conductive element extending along a central axis of the radiating element and electrically coupled to the ground plane, the first electrically conductive disk and the second electrically conductive disk;

at least one feed element in electrical contact with the first electrically conductive disk; and a first wing extending generally perpendicularly from the ground plane, the first wing including two sides and an edge running between the two sides, the edge including a first edge portion closest to the central axis and facing the electrically conductive element, the first edge portion comprising:

a first surface generally proximate to the ground plane and arranged at a first distance from the central axis; and a second surface generally proximate to the second electrically conductive disk and arranged at a second distance, greater than the first distance, from the central axis.

2. The radiating element of claim 1, wherein the first surface is arranged at a third distance with respect to the ground plane and the second surface is arranged at a fourth distance, greater than the third distance, with respect to the ground plane.

3. The radiating element of claim 1, wherein the first wing is defined by:

a height extending from a first end thereof proximate the ground plane to a second free end thereof;

a width extending in a direction generally radially-outward with respect to the central axis; and a thickness, wherein the width of the first wing is varied over the height.

4. The radiating element of claim 3, wherein the first wing comprises a rounded profile on a free end thereof.

5. The radiating element of claim 1, wherein the first wing defines a plane orthogonal to the ground plane.

6. The radiating element of claim 5, wherein the first wing is oriented such that the central axis lies in the plane defined by the first wing.

7. The radiating element of claim 6, further comprising a second wing, the second wing positioned in the plane defined by the first wing.

8. The radiating element of claim 7, wherein the second wing is arranged diametrically opposite the first wing with respect to the central axis.

9. The radiating element of claim 5, wherein the plane of the first wing lies equidistant from the first feed element and a second feed element in electrical contact with the first electrically conductive disk.

10. The radiating element of claim 1, further comprising a dielectric puck arranged on the ground plane and supporting the first electrically conductive disk.

11. An antenna element comprising:

a first electrically conductive disk oriented coaxially with a central axis of the antenna element;

at least one feed element in communication with the first electrically conductive disk; and a first wing defined by:

a height extending from a first end thereof oriented proximate a surface of the antenna element to a second free end thereof;

a width extending in a direction generally radially-outward with respect to the central axis; and a thickness, wherein the width of the first wing is varied over the height such that a width of the first wing proximate to the surface of the antenna element is greater than a width of the first wing at the second free end of the first wing.

12. The antenna element of claim 11, further comprising a second wing defined by:

a height extending from a first end thereof oriented proximate a surface of the antenna element to a second free end thereof;

a width extending in a direction generally radially-outward with respect to the central axis; and a thickness, wherein the width of the first wing is varied over the height.

13. The antenna element of claim 11, further comprising a ground plane, wherein the first wing extends generally perpendicularly with respect to the ground plane.

14. The antenna element of claim 11, wherein the first wing comprises:

a first surface opposing the electrically conductive element arranged at a first distance from the central axis; and a second surface opposing the electrically conductive element arranged at a second distance, different from the first distance, from the central axis.

15. The antenna element of claim 14, wherein the second distance is greater than the first distance.

16. The antenna element of claim 11, wherein the first wing comprises a rounded profile on the second free end.

17. An antenna array, comprising:

a plurality of antenna elements, each antenna element comprising:

a first electrically conductive disk oriented coaxially with a central axis of the antenna element;

at least one feed element in communication with the first electrically conductive disk; and a first wing defined by:

a height extending from a first end thereof oriented proximate a surface of the antenna element to a second free end thereof;

a width extending in a direction generally radially-outward with respect to the central axis; and a thickness, wherein the width of the first wing is varied over the height such that a width of the first wing proximate to the surface of the antenna element is greater than a width of the first wing at the second free end of the first wing.

18. The antenna array of claim 17, further comprising a second wing, the second wing positioned in a plane defined by the first wing.

* * * * *